US009382050B2

(12) United States Patent
Lee

(10) Patent No.: US 9,382,050 B2
(45) Date of Patent: Jul. 5, 2016

(54) AIRTIGHT CONTAINER LID HAVING EASILY DETACHABLE PACKING

(71) Applicant: Young-Won Lee, Seoul (KR)

(72) Inventor: Young-Won Lee, Seoul (KR)

( * ) Notice: Subject to any disclaimer, the term of this patent is extended or adjusted under 35 U.S.C. 154(b) by 0 days.

(21) Appl. No.: 14/414,787

(22) PCT Filed: Jul. 17, 2013

(86) PCT No.: PCT/KR2013/006385

§ 371 (c)(1),
(2) Date: Jan. 14, 2015

(87) PCT Pub. No.: WO2014/014266

PCT Pub. Date: Jan. 23, 2014

(65) Prior Publication Data

US 2015/0166232 A1 Jun. 18, 2015

(30) Foreign Application Priority Data

Jul. 19, 2012 (KR) ..... 10-2012-0078816

(51) Int. Cl.

| | |
|---|---|
| ***B65D 53/00*** | (2006.01) |
| ***B65D 53/02*** | (2006.01) |
| ***B65D 45/20*** | (2006.01) |
| ***B65D 43/06*** | (2006.01) |
| ***B65D 45/02*** | (2006.01) |
| ***B65D 81/20*** | (2006.01) |

(52) U.S. Cl.

CPC ..... *B65D 53/00* (2013.01); *B65D 43/06* (2013.01); *B65D 45/02* (2013.01); *B65D 45/20* (2013.01); *B65D 53/02* (2013.01); *B65D 81/20* (2013.01)

(58) Field of Classification Search

CPC ..... B65D 53/00; B65D 81/20; B65D 43/06; B65D 45/02; B65D 45/20; B65D 53/02

USPC ..... 220/315, 324, 326, 639, 640, 641, 804, 220/378

See application file for complete search history.

(56) References Cited

U.S. PATENT DOCUMENTS

| | | | | |
|---|---|---|---|---|
| 2005/0006390 | A1* | 1/2005 | Wang | B65D 45/30 220/326 |
| 2006/0021889 | A1* | 2/2006 | Kim | A45C 11/00 206/320 |
| 2012/0024856 | A1* | 2/2012 | Smyers | A47G 19/02 220/324 |

(Continued)

FOREIGN PATENT DOCUMENTS

| | | |
|---|---|---|
| JP | 07-330006 A | 12/1995 |
| JP | 10-194310 A | 7/1998 |

(Continued)

*Primary Examiner* — Robert J Hicks
*Assistant Examiner* — Kareen Thomas
(74) *Attorney, Agent, or Firm* — Jefferson IP Law, LLP

(57) ABSTRACT

The present invention relates to an airtight container lid used for an airtight container to seal a container body by a foldable locking element, and more particularly, a sealing packing is easily detached without being damaged while the sealing packing is installed in the lid, thereby solving an unhygienic problem generated in a region in which the packing is installed. That is, the packing can be easily detached, and it is possible to seal and hygienically clean the region in which the packing of the lid is installed.

To this end, a lid is divided into an upper surface, which covers a container body, and a rim having a locking element, the upper surface is detachably coupled to the rim, and an installation groove is formed to closely couple a packing when the upper surface and the rim are coupled and the installation groove is removed when the upper surface and the rim are separated so that the packing is easily attached and separated and the installation groove is easily cleaned.

In addition, the upper surface constituting the lid is formed of a material having no environmental hormones, so sealing is easily achieved and complete sanitation is implemented.

4 Claims, 9 Drawing Sheets

(56) References Cited

U.S. PATENT DOCUMENTS

2014/0217101 A1* 8/2014 Wang ..... B65D 45/00
220/324

FOREIGN PATENT DOCUMENTS

KR 10-0530531 B1 11/2005
KR 10-2010-0107106 A 10/2010

* cited by examiner

AIRTIGHT CONTAINER LID HAVING EASILY DETACHABLE PACKING

TECHNICAL FIELD

The present invention relates to an airtight container lid used for an airtight container to seal a container body by a foldable locking element, and more particularly, a sealing packing is easily detached without being damaged while the sealing packing is installed in the lid, thereby solving an unhygienic problem generated in a region in which the packing is installed.

That is, the packing can be easily detached, and it is possible to seal and hygienically clean the region in which the packing of the lid is installed.

BACKGROUND ART

Currently, container bodies of airtight containers are being varied to various forms as a material of the container bodies is changed from plastic to glass, ceramics, and stainless steel, which do not emit environmental hormones. In order to allow a lid to be coupled with the container body in an airtight state, locking elements and elasticity are required. For this reason, a plastic lid is commonly used.

In addition, a packing is used in the lid as a basic element for sealing. The packing is installed in the lid, which is mainly formed of plastic. In order to install the packing, an installation groove is formed to prevent the packing from separating when the packing installed in the lid is pressed.

Therefore, when the packing, which is installed in the installation groove, makes contact with food contained in the container body while being pressed, foreign substances are caught in a gap of the packing, which is installed in the installation groove, and the foreign substances are rarely cleaned, thus the foreign substances become a source of odor when a predetermined time elapses, and the odor is unsanitary due to propagation of germs.

For this reason, currently, to easily attach and detach the packing, a packing having a shape other than a ring shape is used, or an opening, through which a stick is inserted to forcefully take out the packing for an easy cleaning, is formed in a predetermined portion of the installation groove.

However, cleaning the solidified foreign substance, which is trapped in the installation groove, just by separating the packing is difficult due to the narrow width of the installation groove, so the unsanitary part is not resolved by cleaning.

In addition, when the packing is pulled by the stick through the opening, the packing may be broken if the packing is aged, thus the airtight container may be damaged, causing unnecessary waste.

DISCLOSURE

Technical Problem

Therefore, according to the present invention, the packing is easily attached and detached to the lid while being easily cleaned in situ and the food contained in the container does not make contact with a typical harmful plastic, thereby solving the unhygienic problem.

Technical Solution

To this end, a lid is divided into an upper surface, which covers a container body, and a rim having a locking element, the upper surface is detachably coupled to the rim, and an installation groove is formed to closely couple a packing when the upper surface and the rim are coupled and the installation groove is removed when the upper surface and the rim are separated so that the packing is easily attached and separated and the installation groove is easily cleaned.

In addition, the upper surface constituting the lid is formed of a material having no environmental hormones, so sealing is easily achieved and complete sanitation is implemented.

Advantageous Effects

Therefore, by allowing the packing to be easily installed and separated through making the upper surface and the rim of the lid to be detachably coupled with each other, the packing and the lid are easily cleaned, and by forming the upper surface using various materials, lids having various designs without environmental hormones can be provided.

BEST MODE

Figure 1:
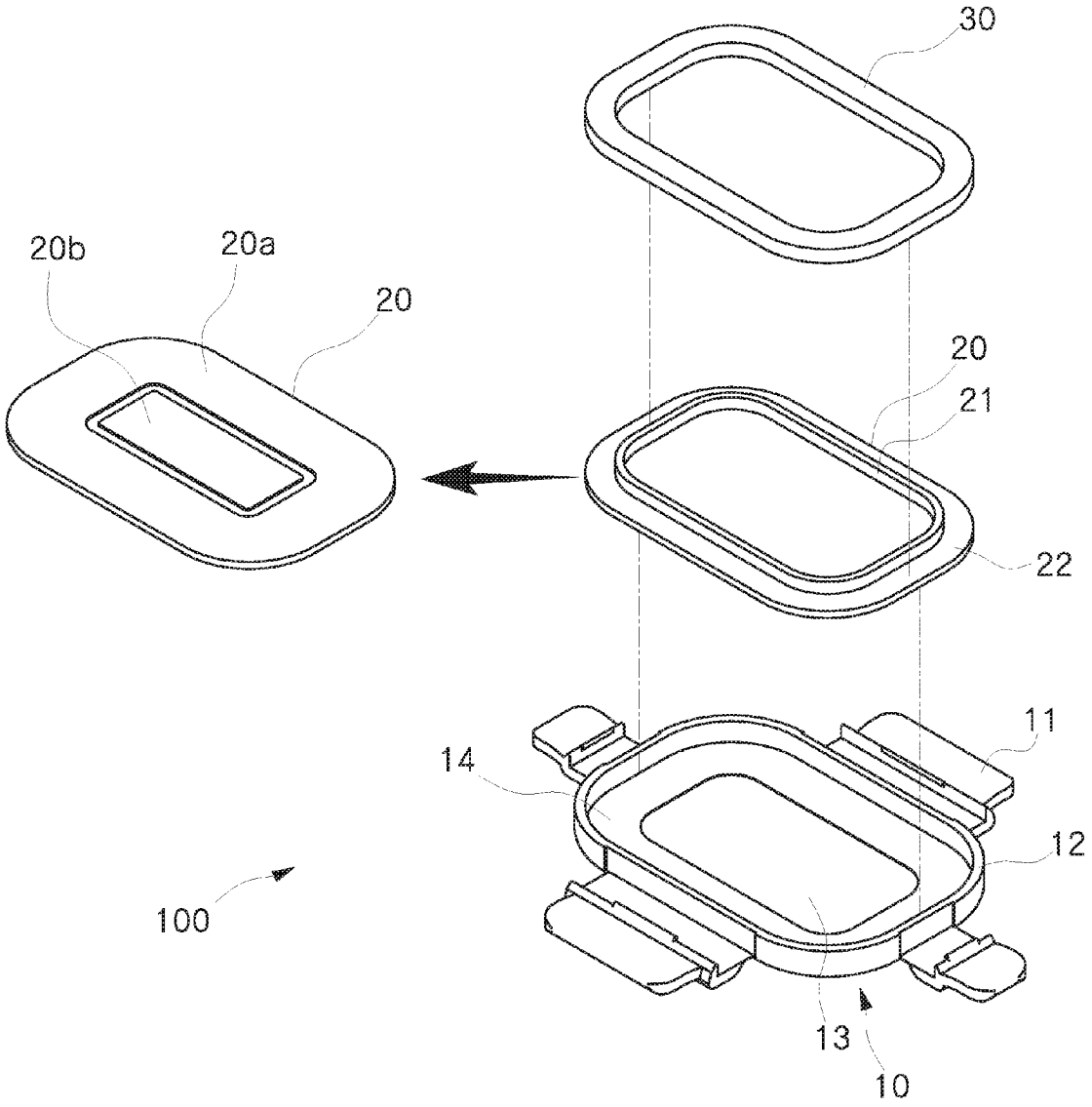
FIG. 1 is a perspective view illustrating an assembly of a lid according to an embodiment of the present invention.

An exemplary embodiment of the present invention, in which the lid 100 is detachably coupled to a container body 200 to seal the container body 200 by using a packing 30, the lid 100 includes: a rim member 10 detachably formed to seal the container body 200; and an upper surface member (20) detachably coupled to the rim member 10 by applying pressure, wherein an installation groove (1) to install the packing (30) is formed as an upper surface (20*a*), which covers an opened upper end of the container body as the rim member is coupled to the upper surface member, is coupled to the upper surface member (20) and the rim member (10) to install the packing (30).

[Mode for Invention]

Hereinafter, the present invention will be described in detail with reference to the accompanying drawings.

Figure 2:
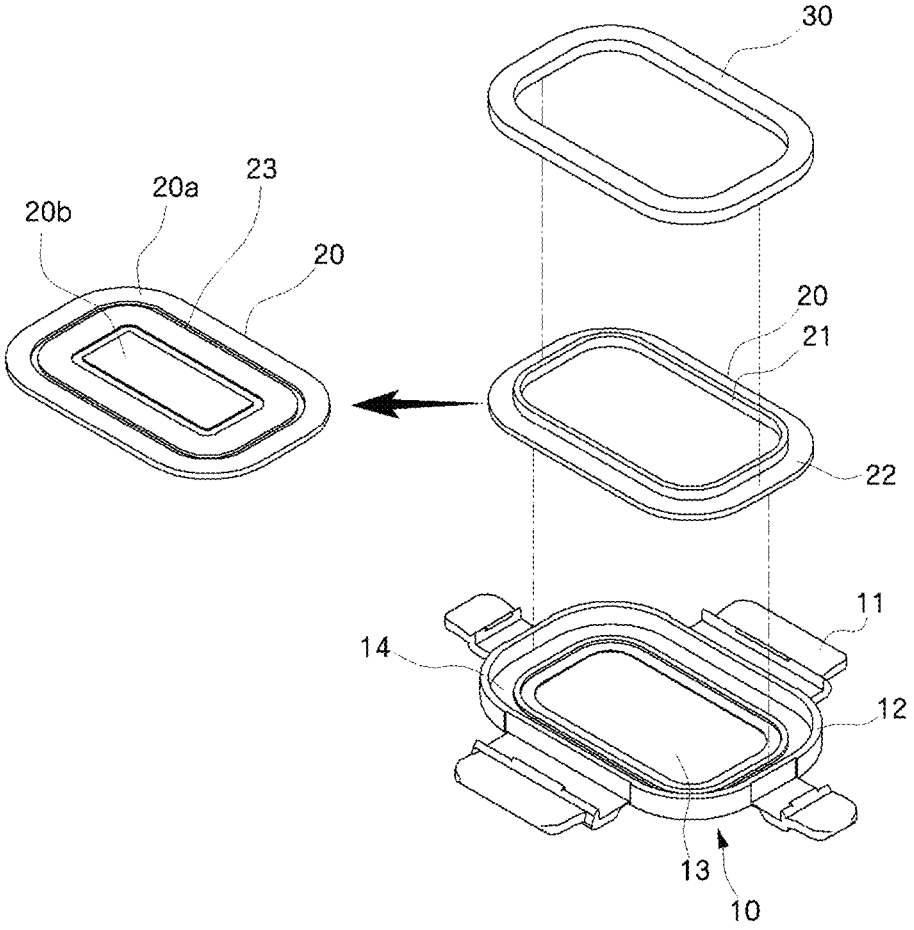
FIG. 2 is a perspective view illustrating an upper surface member and a rim member constituting the lid according to an embodiment of the present invention, which are separated and coupled in a different structure.
Figure 3:
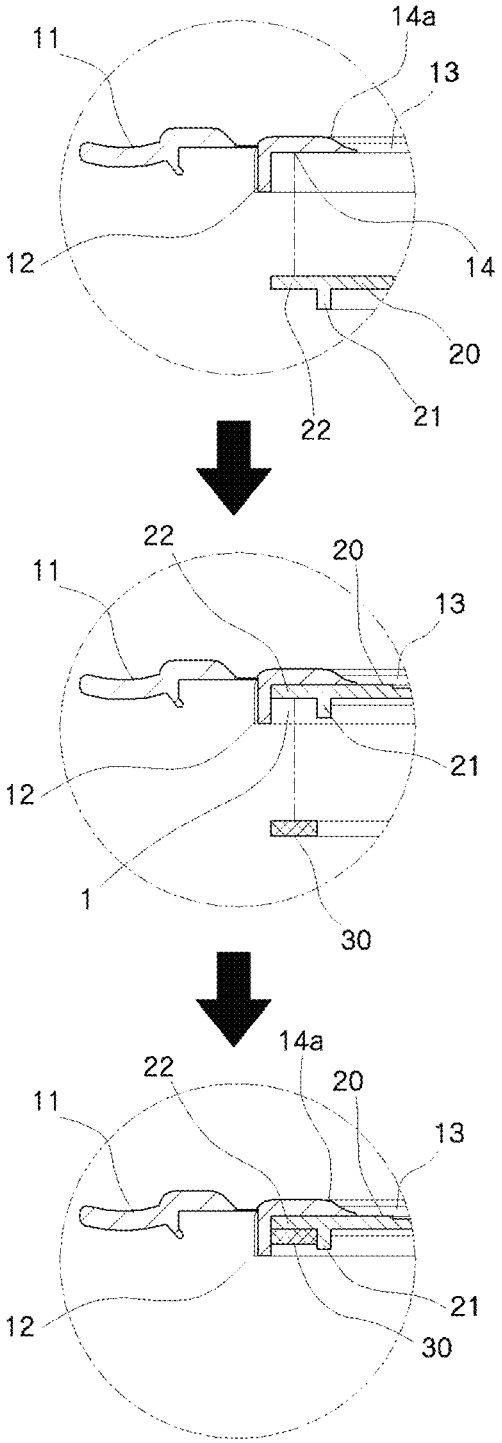
FIG. 3 is a sectional view illustrating the upper surface member to be coupled to the rim member of the FIG. 1.
Figure 4:
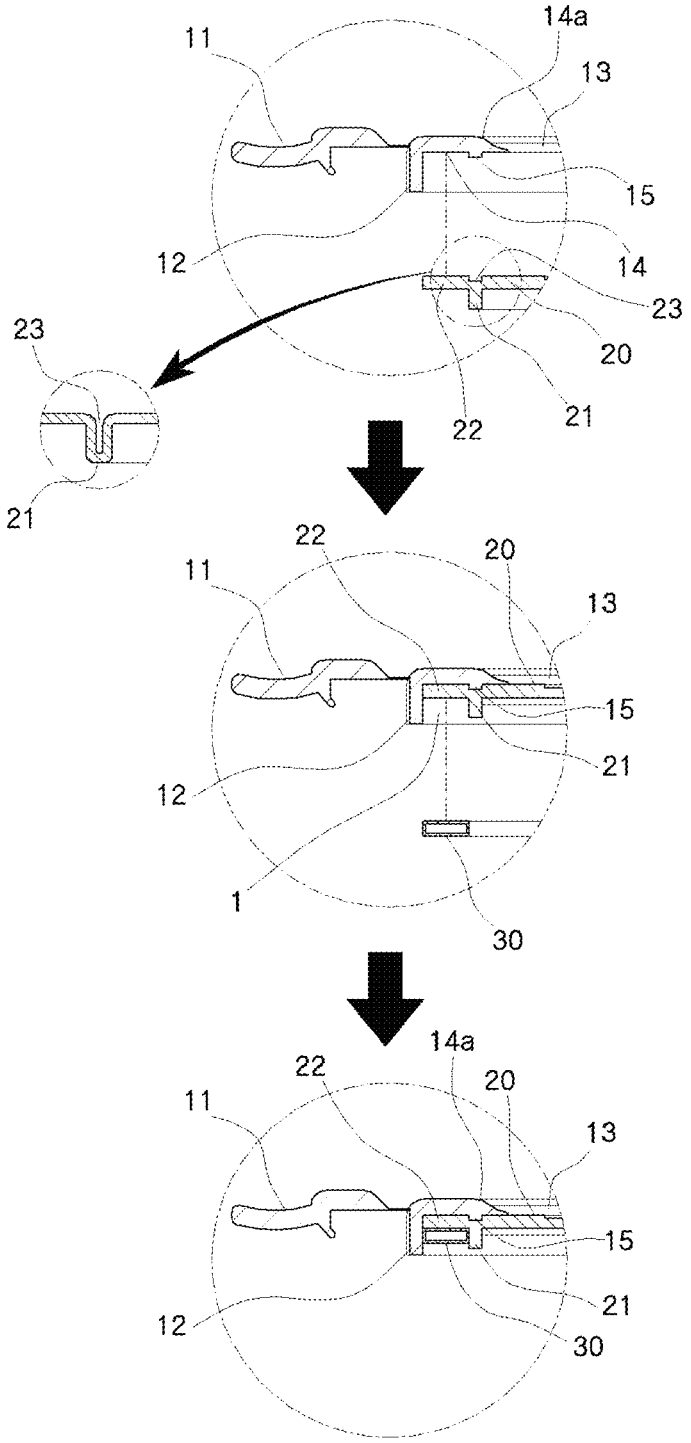
FIG. 4 is a sectional view illustrating another upper surface member to be coupled to the rim member.
Figure 5:
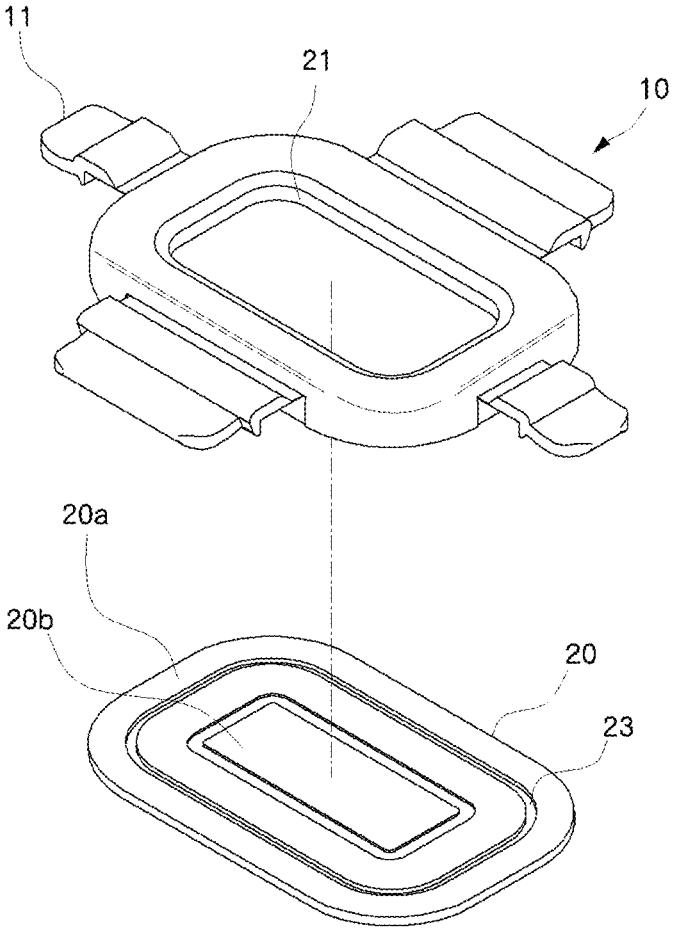
FIG. 5 is a view illustrating the upper surface member having an inserting groove.
Figure 6:
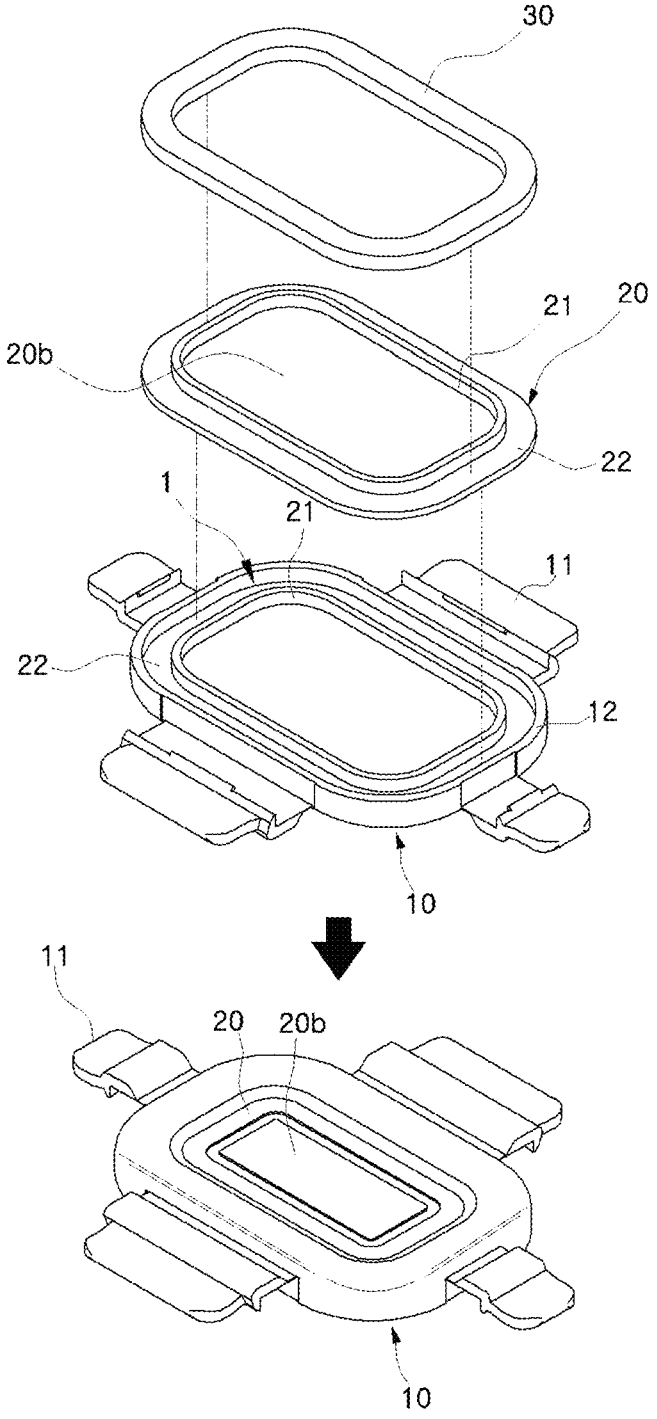
FIG. 6 is a view illustrating a lid in which the upper surface member is assembled to the rim member.
Figure 7:
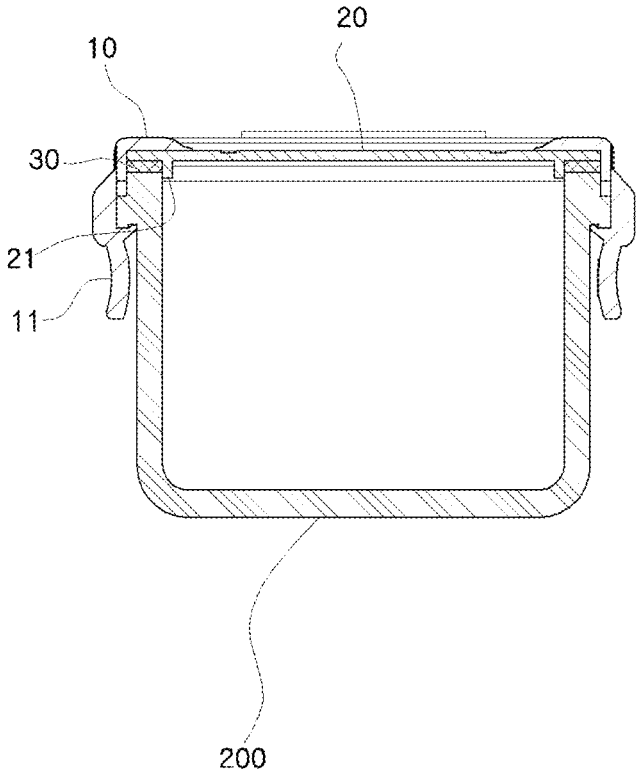
FIG. 7 is a sectional view illustrating the lid coupled to the container body.
Figure 8:
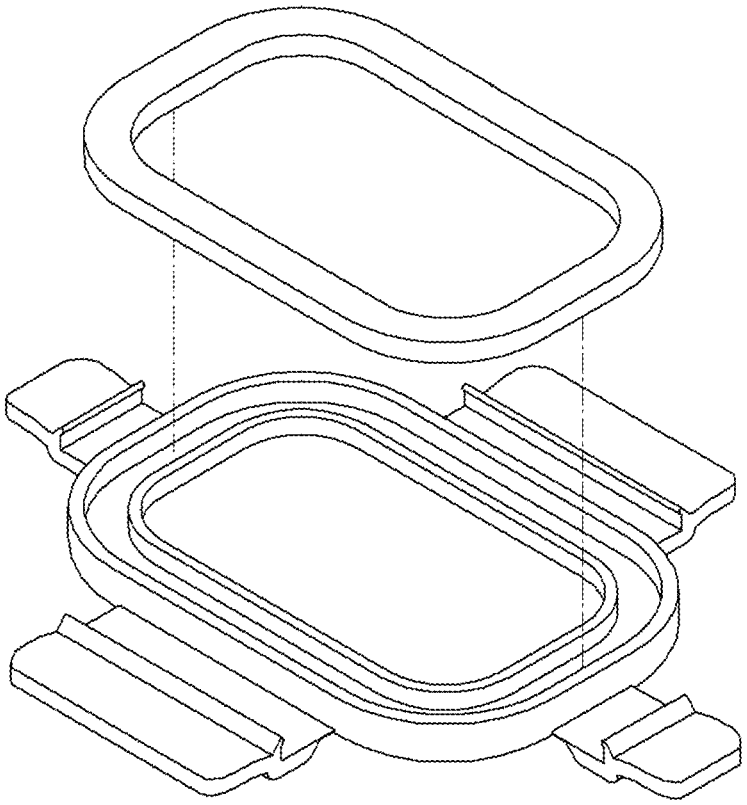
FIG. 8 is a view illustrating a packing detached from a typical lid.
Figure 9:
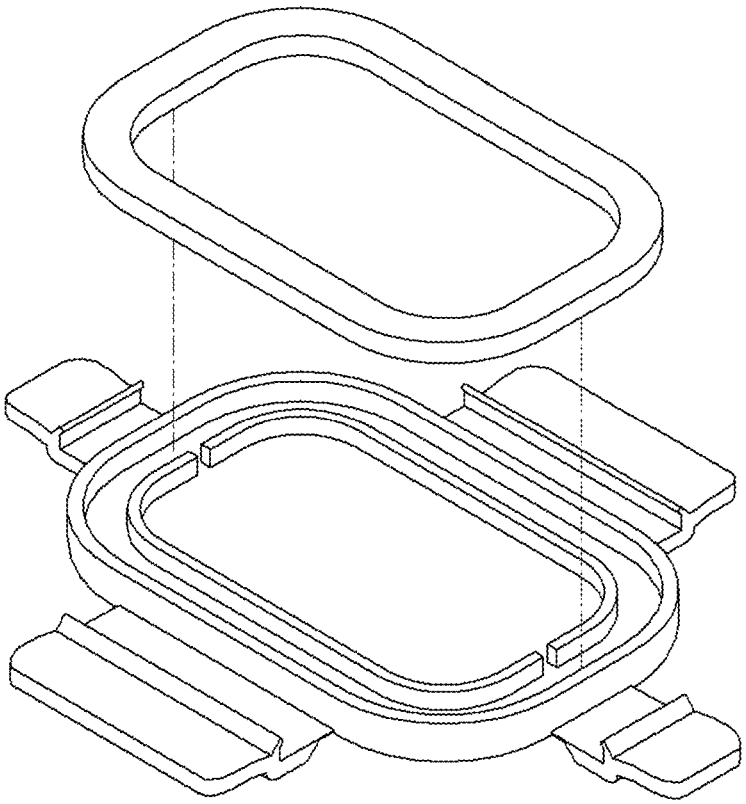
FIG. 9 is a view of the typical lid having an opening groove to easily attach and detach the packing.

FIGS. 1 and 2 illustrate an upper surface member of various shapes, which constitutes the upper surface of the lid, and a packing, which encloses the upper surface member, coupled to the rim member, FIGS. 3 and 4 are sectional views of the rim member coupled according to mutually different forms of the upper surface member of the upper surface member of FIGS. 1 and 2, FIG. 5 is an enlarged view of the upper surface member closely coupled to the rim member, FIG. 6 is a view of an assembly of an embodiment of the present invention and FIG. 7 is a view of the lid of an embodiment of the present invention coupled to the container.

As illustrated above, a lid 100 of an embodiment of the present invention coupled to a container body 200, includes a rim member 10 having a foldable locking element 11, an upper surface member 20 detachably coupled to the rim member 10 by applying pressure, and a packing 30 inserted into an installation groove 1 which is generated when the upper surface member 20 and the rim member 10 are coupled.

In this case, in the upper surface member 20, a protruding rim 21, which protrudes inward, is formed while a flange 22 having a predetermined width is formed to form an installation groove 1 for installing the packing 30 when coupled to the rim member 10.

In addition, the flange 22 having a predetermined width is provided outside of the protruding rim 21 to secure a space, in which the packing 30 is installed, and the rim member coupled to the upper surface member 20 includes an outer wall 11 elastically supported as external force is applied thereto by an outer rim of the flange 22 of the upper surface member, and a support rim 14 formed inside the outer wall 12 and having a predetermined width so that the flange 22 of the upper surface member 10 is pressed, and an opening 13, through which the upper surface 20*b* of the upper surface member 20 is exposed, provided inside the support rim 14.

Therefore, when the upper surface member 20 is coupled to the rim member 10, the installation groove 1, on which the packing 30 is installed, having a predetermined depth is formed by an outer wall 12 of the rim member 10, on the protruding rim 21 which protrudes inward in the upper surface member 20.

In addition, when the upper surface member 20 and the rim member 10 are separated, the installation groove 1 having a predetermined depth is removed and the flange 22 of the upper surface member 20 and the support rim 14 of the rim member 10 are exposed such that a region where the packing 30 is installed can be easily cleaned.

In addition, the support rim 14 of the rim member 10 is supported stronger than a pressure applied when the lid 100 is coupled to the container body 200 by the locking element 11, which is folded in the rim member 10, and specifically, in an embodiment of the present invention, an edge 14*a* of the support rim 14, which is adjacent to the opening 13 of the rim member 10, has a front end thinner than a rear end and is bent inward and is pressed against the upper surface and closely adheres to the upper surface to closely adhere to the upper surface (20*a*) of the upper surface member (20) when the lid 100 is locked to the container body 200 by applying pressure.

But this configuration does not limit the object of the present invention, and the close adherence for the sealing may be implemented by various configurations of prior arts.

In addition, for a closely sealed coupling of the upper surface member 20 and the rim member 10, a recessed rim 23 is provided at the upper surface 20*a* of the upper surface member 20 in a predetermined depth, in which the recessed rim 23 is positioned at a part where the support rim 14 of the rim member 20 is protruding, and a protruding rim 15 protrudes from the support rim 14 so that the protruding rim 15 may be inserted into the recessed rim 23.

Therefore, the coupling of the recessed rim 23 and the protruding rim 15 enlarges a surface, on which the upper surface 2*a* of the upper surface member 20 and the support rim 14 of the rim member 10 makes contact, so that the rim member is prevented from transforming and for a closely adhered coupling.

The rim member 10 is injection molded from plastic, and a transformation by a gap occurring according a contraction and expansion of the rim member 10, which is molded from plastic, can be prevented while the upper surface member 20 and the rim member 10 are coupled.

In this case, a display part 20*b*, on which a logo, etc. is printed or imprinted, is formed on the exposed upper surface 20*a* of the upper surface member 20, which is exposed through the opening 13 of the rim member 10.

In addition the recessed rim 23 is curved when forming the protruding rim 21 of the upper surface member 20 so that the upper surface member 20 is easily processed by a press mold when processing from metal, and the protruding rim 21 is closely adhered to an inner wall of the container when coupled to the container 200 so that the food contained in the inner space is fundamentally prevented from making contact with a non-harmful material.

In addition, the upper surface member 20 of the present invention uses a material not harmful to human, and at the same time, a material having a stronger strength than the rim member 10 is used so that the elastic rim member 10 is easily coupled and separated from the upper surface member 20 by simply pressing the upper surface of the upper surface member 20 without transforming the upper surface member 20.

The material used for the upper surface member, which is not harmful to human, used in the present invention may be stainless steel, tempered glass or ceramic and plastic which is not harmful, but these materials do not limit the object of the present invention.

The invention claimed is:

1. An airtight container lid having an easily detachable packing, in which the lid is detachably coupled to a container body (200) to seal the container body by using the packing, the lid comprising:

a rim member detachably formed to seal the container body; and an upper surface member detachably coupled to the rim member by applying pressure, wherein an installation groove to install the packing is formed as a first upper surface, which covers an opened upper end of the container body as the rim member is coupled to the upper surface member, wherein the upper surface member comprises a protruding rim, which protrudes inward to form the installation groove, a flange having a predetermined width is provided at an outside of the protruding rim to secure a space, in which the packing is installed, and wherein the rim member comprises an outer wall elastically supported as external force is applied thereto by an outer rim of the flange of the upper surface member, which adheres to the outer wall, an opening, through which a second upper surface of the upper surface member is exposed, and a support rim formed between the outer wall and the opening and having a predetermined width to support the first upper surface of the upper surface member.

2. The lid according to claim 1, wherein the support rim of the rim member is supported stronger than a pressure applied when the lid is coupled to the container body, an edge of the support rim, which is adjacent to the opening of the rim member, is pressed against the upper surface and closely adheres to the upper surface to closely adhere to the upper surface of the upper surface member when the lid is locked to the container by applying pressure.

3. The lid according to claim 1, wherein a recessed rim is provided at the first upper surface of the upper surface member in a predetermined depth, in which the recessed rim is positioned at a part where the support rim of the rim member is supported, and a protruding rim protrudes from the support rim so that the protruding rim is inserted into the recessed rim.

4. The lid according to claim 1, wherein the protruding rim of the upper surface member is disposed in the container body when coupled to the container body, the upper surface member has a stronger strength than the rim member so that the upper surface member is easily coupled to the flexible rim member even by simply applying pressure when attached to or detached from the rim member without transforming the upper surface member.

* * * * *